US005474194A

United States Patent [19]

Heilman et al.

[11] Patent Number: 5,474,194

[45] Date of Patent: Dec. 12, 1995

[54] CLOSURE WITH IRREVERSIBLE COLOR CHANGE SYSTEM

[75] Inventors: Robert J. Heilman, Orland Park; Mark Egger, Riverside; Leonard Rozanksi, Chicago; H. Darrell Iler, Wheaton, all of Ill.

[73] Assignee: Continental White Cap, Inc., Downers Grove, Ill.

[21] Appl. No.: 556,530

[22] Filed: Jul. 9, 1990

[51] Int. Cl.[6] ..... B65D 39/00

[52] U.S. Cl. ..... 215/230; 215/250; 215/270; 215/271; 428/209; 428/916

[58] Field of Search ..... 215/230, 232, 215/233, 250, 262, 270, 271; 206/459; 53/410, 420, 490; 428/209, 916

[56] References Cited

U.S. PATENT DOCUMENTS

| | | | |
|---|---|---|---|
| 3,783,089 | 1/1974 | Hurst et al. | 428/209 |
| 3,935,960 | 2/1976 | Cornell | 220/260 |
| 4,451,523 | 5/1984 | Nativi et al. | 428/209 |
| 4,479,585 | 10/1984 | Sandhaus | 215/218 |
| 4,502,605 | 3/1985 | Wloszczyna | 215/230 |
| 4,505,399 | 3/1985 | Weiner | 215/230 |
| 4,526,752 | 7/1985 | Perlman et al. | 206/459 X |
| 4,718,553 | 1/1988 | Ademoli et al. | 206/459 |
| 4,759,445 | 7/1988 | McVay | 206/524.2 |
| 4,890,763 | 1/1990 | Curiel | 220/455 |

*Primary Examiner*—Allan N. Shoap
*Assistant Examiner*—Stephen Cronin
*Attorney, Agent, or Firm*—Lockwood, Alex, FitzGibbon & Cummings

[57] ABSTRACT

This relates to a color change system to be incorporated in a flexing area of an end panel of a closure. The color change system includes a dark background coating on a flexing portion of the closure end panel to which there is bonded by way of an adhesive such as a varnish, ink or coating a brittle layer which due to the flipping action of the flexing portion of the end panel will fracture. The brittle layer is preferably of a light color and is colored utilizing a fluorescent dye. The combination of the background color and the fluorescent color of the brittle layer produces a first color in the original closure and when the end panel flexes and the brittle layer fractures to not only crack but also tear apart or delaminate from itself, to reflect its own light color much more brilliantly, the color of the color change system drastically changes to indicate tampering. This color change is irreversible. The color change system may also include a message indicia.

28 Claims, 3 Drawing Sheets

CLOSURE WITH IRREVERSIBLE COLOR CHANGE SYSTEM

This invention relates in general to new and useful improvements in closures having end panels of which at least an area is formed to flex when the closure is applied to a container, and more particularly to a closure wherein the flexible area of the end panel is provided with a tamper indicating system in the form of a color change system.

BACKGROUND OF THE INVENTION

Closures having end panels incorporating vacuum indicating buttons are used extensively for the food industry because they are effective quick-detection means that lets one know some very important conditions about the container. When the container is properly sealed and a vacuum exists therein, the button is in a "down" position while if the container has been opened and the closure reapplied, or the vacuum within the container otherwise lost, the button will be in its "up" position.

While closures having vacuum actuated buttons are predominately in use, there has been more recently developed closures with buttons which are mechanically actuated so as to move from an as formed "down" position to an upwardly projecting "up" position when the closure is properly applied to a container.

In both end panel displacement systems, there is a need for an irreversible type of tamper indicating system for use in conjunction with closures having deflectable end panel areas, such as buttons.

SUMMARY OF THE INVENTION

In accordance with this invention, it is proposed to incorporate a fluorescent dye into an epoxy base brittle coating system for deflectable end panel areas, particularly buttons, so as to provide a visually distinct indicator for panel area flipping. This system involves applying an epoxy system with an orange colored fluorescent dye over a black colored closure button or other deflectable end panel areas. In its unfractured state, the fluorescent color of the brittle coating is effectively quenched by the dark background color of the underlying area of the end panel producing a dark low reflective green color. Upon end panel flipping, the coating fractures and loses adhesion to the black coated area. The adhesion release and fracturing causes the brittle coating to reflect its fluorescent orange color much more brightly, producing a very obvious change in the appearance of the coating system.

With the above and other objects in view that will hereinafter appear, the nature of the invention will be more clearly understood by reference to the following detailed description, the appended claims, and the several views illustrated in the accompanying drawings.

DISCLOSURE OF PREFERRED EMBODIMENT OF INVENTION

Figure 1:
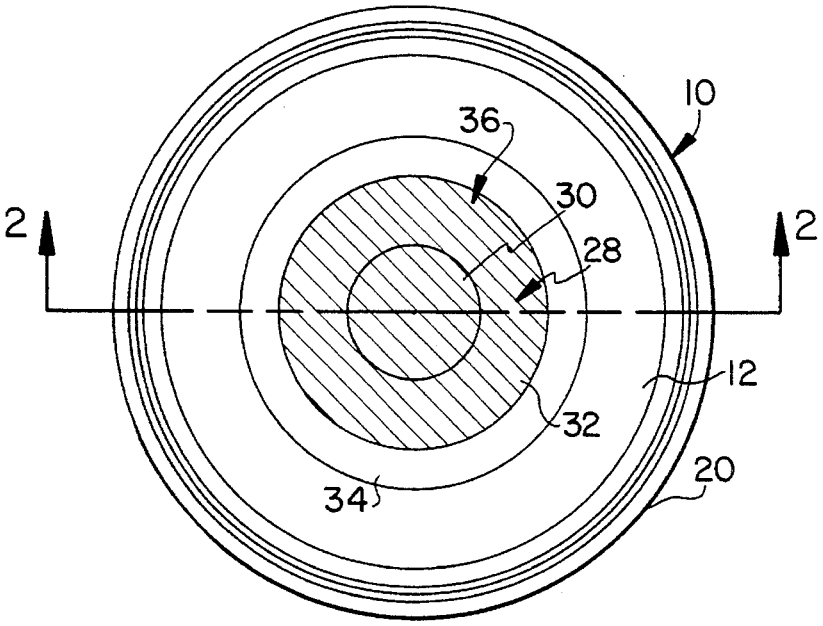
FIG. 1 is a plan view of a closure wherein the end panel of the closure is provided with a button that is vacuum actuated and which flips when the vacuum is removed.
Figure 2:
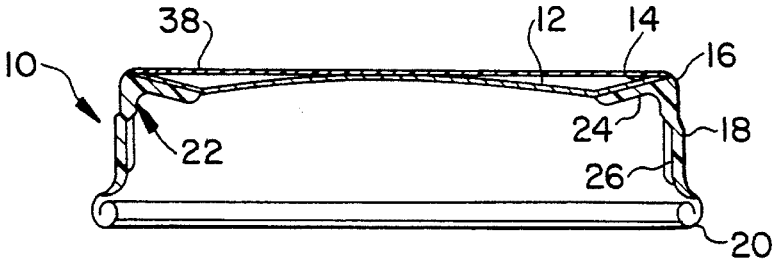
FIG. 2 is a vertical sectional view taken generally along the line 2—2 of FIG. 1 and shows more specifically the constructional detail of the closure.

Referring now to the drawings in detail, with particular reference to FIGS. 1 and 2, it will be seen that there is illustrated a closure which is formed in accordance with this invention. The closure is generally identified by the number 10 and includes an end panel 12 which has an upwardly and outwardly sloping outer annular portion 14 and terminates in a corner 16 where it is joined to an upper edge of a generally cylindrical skirt 18. The skirt 18 terminates in an inwardly directed curl 20.

It is intended that the closure 10 be of the push-on type and be associated with a container having a neck finish including threads. Accordingly, there is applied to the interior of the closure 10 a sealing compound 22 which includes an upper portion 24 for forming a seal with a container end finish, the upper portion 24 underlying the annular peripheral portion 14 of the end panel 12. The sealing compound 22 also includes a portion 26 which lines the skirt 18 and which is deformed so as to match the threads on a container neck finish and function as means for effecting the removal of the closure from the container in a twisting action.

The closure 10 is constructed in a manner wherein the end panel 12 is provided with a centrally located button generally identified by the numeral 28. The button 28 includes a central post area 30 surrounded by a downwardly and outwardly sloping annular area 32 which, in turn, is surrounded by a generally flattened annular area 34. It is preferred that the button 28 be of the type which has been mechanically worked after its initial formation so that it will have a high flipping energy as will be described in more detail hereinafter.

Most specifically, in accordance with this invention, the button 28 is provided with a tamper indicating color change system generally identified by the numeral 36 and is visible in FIG. 1 only by the color thereof.

There is also provided a transparent cover 38 which is best illustrated in FIG. 2 and which overlies and protects the color change system 36.

Basically, the color change system 36 includes a dark background 40 on the button 28 followed by an adhesive coating 42 which bonds a brittle layer 44 to the background 40. The closure otherwise will normally be of a white appearance although the white coating is not illustrated.

Figure 3:
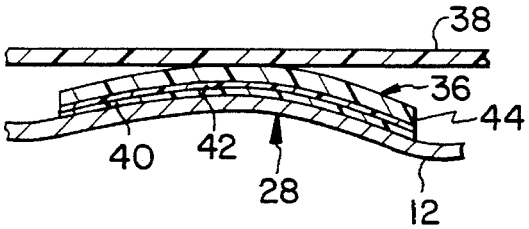
FIG. 3 is an enlarged fragmentary vertical sectional view taken through the central area of the end panel of the closure of FIGS. 1 and 2 shows more specifically the details of a coating system provided on the button.
Figure 4:
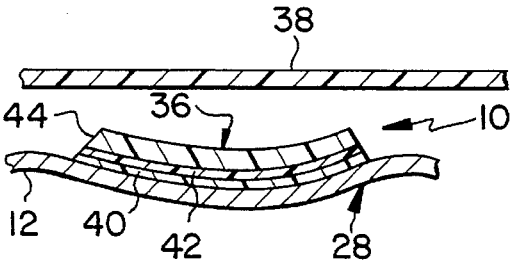
FIG. 4 is an enlarged fragmentary vertical sectional view similar to FIG. 3 and shows the button moved to its "down" position by a vacuum within an associated container.

Referring now to FIG. 4 in particular, it will be seen that when the closure 10 is applied to a container and a vacuum is drawn within such container, the button 28 is drawn downwardly. At this time it is pointed out that due to the mechanical working of the button 28 as the closure 10 is being formed the button 28 has certain stored compressive stresses which facilitates its being maintained in the "up" position of FIG. 3. When the button 28 is drawn down into the container as shown in FIG. 4, these compressive stresses increase and there is a high tendency for the button 28 to flip upwardly from its "down" position of FIG. 4 back to its original position of FIG. 3. Thus when the closure 10 is removed from a container and the vacuum applied against the underside of the end panel 12 is released, the button 28 will flip or snap upwardly to its original position of FIG. 3. It is this flipping action of the button 28 that is relied upon to actuate the color change system 36 and more particularly to effect a fracturing and cracking of the brittle layer 44.

SPECIFIC DETAILS OF COLOR CHANGE SYSTEM

While the invention has thus broadly been described a description of more specific details of the color change system 36 is now made.

Considering first the background coating 40, it is understood that the background coating 40 must be of a dark color and while it is preferred that the color of the background coating 40 be black containing some blue, other dark colored backgrounds will also give a sufficient color contrast.

A bonding layer 42 which bonds the brittle layer 44 to the colored background coating 40 is in the form of an appropriate varnish, ink or coating. Further, the bonding layer 42 must be generally transparent and one which provides a good adhesion between the brittle layer and the bonding layer 42 although a certain separation of the bonding layer 42 and the background color coating 40 is desirable.

The brittle layer 44 is formed of a brittle resin and should be a thermoset material that has proper fracturing and adhesion properties in order to work properly. It has been found that a two part epoxy system based on diglycidyl ether of bisphenol A and a teriary amine curing agent is a suitable material. At the present, this epoxy system is applied to the button area of the closure 10 after the closure has been applied to a container and the button 28 in its "down" position. It is, however, preferred that the brittle layer 44 be applied to the closure by the closure manufacturer.

Other thermoset materials such as epoxy functional polyacrylates should provide a way of applying the resin to the button area by the manufacturer. The epoxy functional polyacrylates are tough and flexible allowing them to withstand shipping and handling abuse. At the present, these materials are being cured by way of U.V. irradiation, heat, etc. after the closure 10 has been applied to a container and the button 28 has moved to its "down" position to induce the needed brittleness.

Figure 5:
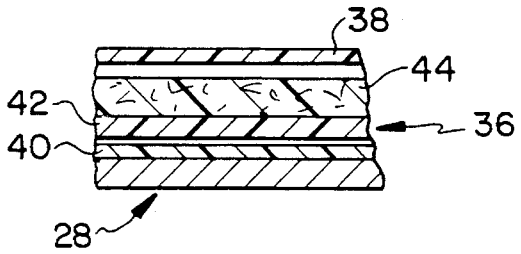
FIG. 5 is an enlarged fragmentary sectional view taken through the center of the closure after the closure has been removed from a container and the button has flipped to its "up" position causing a change in the tamper indicating color system.
Figure 6:
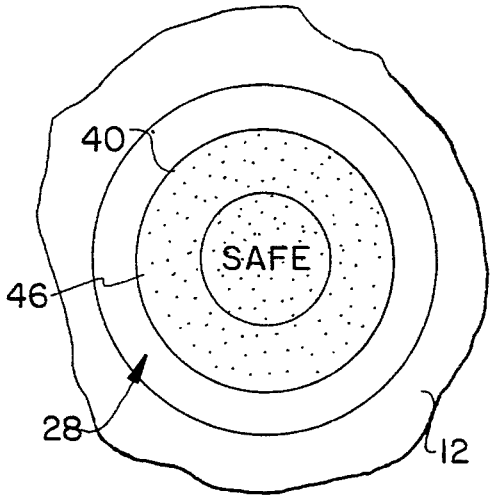
FIG. 6 is a fragmentary plan view of the button area of the closure showing the dark background thereof and message indicia thereon prior to the application of the remainder of the color system.

Returning once again most specifically to the drawings, reference is made to FIG. 5 wherein there is illustrated the central part of the button 28 after the closure 10 has been applied to a container and the button 28 has flipped from its "down" position of FIG. 4 to its "up" position of FIG. 3. Due to the flipping action of the button 38, the brittle layer 44 has fractured and in part delaminates from itself. There is also a certain separation of the varnish bonding layer 42 from the background coating 40. This cohesive failure of the brittle layer 36, due to the fact that it is provided with a fluorescent dye results in a greatly enhanced fluorescent color. At the same time, the transparent cover layer 38 prevents any loss of particles of the fractured brittle layer 44.

Although experiment has shown that a generally black colored coating 40 associated with an orange colored brittle layer 46 provides the best result in that the color change system 44 initially has a generally green color followed by a change to orange when the brittle layer 46 fractures, it is to be understood that other color combinations are feasible and that the color change system 36 is not restricted to the orange-black combination.

Figure 8:
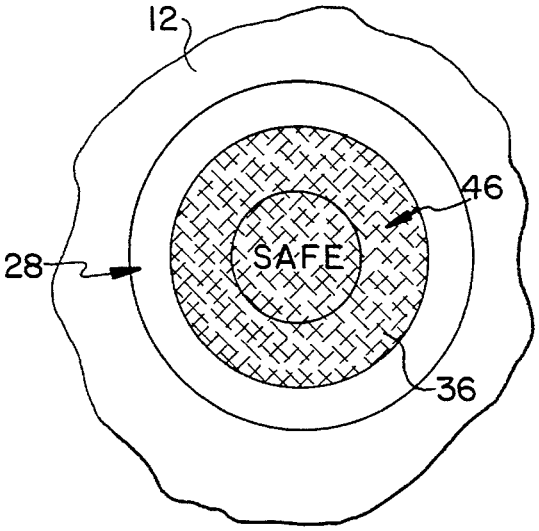
FIG. 8 is a fragmentary plan view showing the button area of the closure after it has been removed and the button has been flipped to its "up" position causing a color change and the disappearance of the message indicia.

It is further proposed to provide the background coating 40 with message indicia 46 such as the word "SAFE". The message indicia 46 may be applied over the coating 40 or may be in the form of uncoated areas with the basic color of the closure 10 showing through. The message indicia 46 is viewable in the initial state of the color change system 36 but disappears when the brittle layer 44 fractures as is best shown in FIG. 8.

Figure 7:
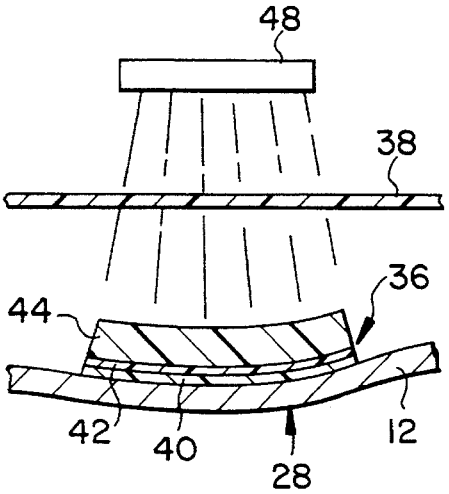
FIG. 7 is a schematic sectional view showing the manner in which the color system may be cured after the closure has been applied to a container and the button deformed by a vacuum within the container.

In FIG. 7, there is illustrated schematically how a curing operation may be effected on the brittle coating material utilizing a curing source 48 such as U.V. irradiation, heat, etc.

DISCLOSURE OF MODIFIED FORM

Figure 9:
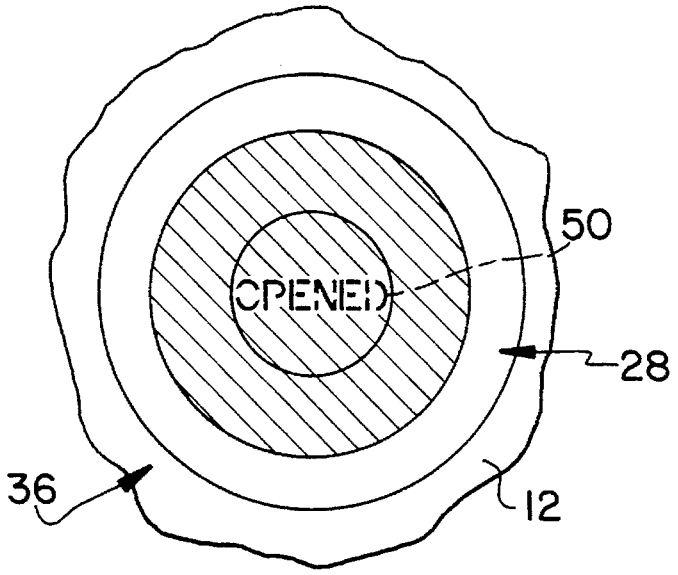
FIG. 9 is a top plan view of another form of the invention wherein the message indicia is applied to the brittle coating and is not truly visible.
Figure 10:
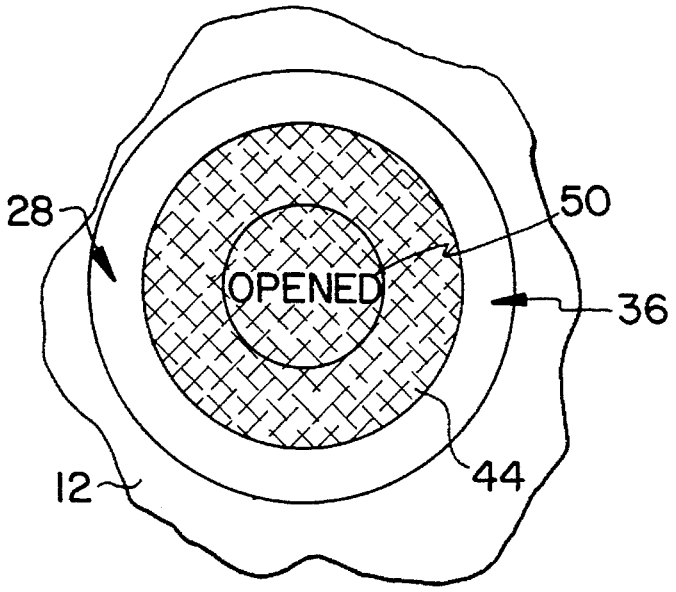
FIG. 10 is a top plan view similar to FIG. 9 and shows the brittle coating fractured and the message indicia being visible.

In FIGS. 9 and 10 there is illustrated a modified message indicia arrangement identified by the numeral 50. In lieu of the message indicia being visible only when the container has not been opened, the message indicia 50 is viewable only when the closure 10 has been applied and removed.

The message indicia 50 is applied over the brittle layer 44 and is of a color to blend with the background coating 40 when the closure 10 is applied to a container so as to not be visible. However, when the closure 10 is removed and the brittle layer 44 fractures and assumes its fluorescent orange color, the dark or black message indicia 50 will appear. The wording of the message indicia may be "OPENED", for example, and specifically indicate that the closure 10 has been used and the associated container previously opened.

Further, it is particularly pointed out here that while in the illustrated and described preferred embodiment of the invention the color change system 36 is applied to a vacuum actuated button, the invention is not so limited. The color change system may be applied to any flexing portion of the end panel 12. Further, the flexing need not be effected by a vacuum, but could be generated by a mechanical action due to the engagement of portions of the end panel with the end sealing surface of the container.

It is to be most particularly understood that with the color change system 36 in operation, once a closure so equipped has been placed on a container in sealed relation and then removed therefrom, the color change forms a permanent and irreversible indication that the container has been previously opened no matter how the closure is reapplied.

Although only a preferred embodiment of the invention has been specifically illustrated and described herein, it is to be understood minor variations may be made therein without departing from the spirit and scope of the invention as defined by the appended claims.

We claim:

1. A closure including a flexible end panel having formed therein a sealing state indicating area, and an irreversible tamper indicating system carried by said end panel area and actuable by said area flipping from a seal indicating position back to an initial position due to energy stored within said end panel, said tamper indicating system including a brittle layer rupturable in response to flipping of said end panel area, said brittle layer having a first color when said brittle layer is whole and a second color when said brittle layer ruptures.

2. A closure according to claim 1 wherein said brittle layer is formed of a resin.

3. A closure according to claim 2 wherein said resin is a thermoset material.

4. A closure according to claim 2 wherein said resin is an epoxy.

5. A closure according to claim 1 wherein said brittle layer initially is a tough and flexible layer to allow said closure to withstand shipping and handling abuse.

6. A closure according to claim 5 wherein said tough and flexible layer is treated to render said layer brittle.

7. A closure according to claim 5 wherein said tough and flexible layer is treated to render said layer brittle after said closure has been applied to a container and said end panel has deflected.

8. A closure according to claim 1 wherein said sealing state indicating area is in the form of a button.

9. A closure according to claim 1 wherein said brittle layer is colored with a fluorescent dye.

10. A closure according to claim 1 wherein said brittle layer has a bond with said end panel which is releasable when said end panel flips from said seal indicating position back to said initial position.

11. A closure according to claim 1 wherein there is a bond between said brittle layer and said end panel, and the material of said brittle layer is one wherein upon flipping of said end panel said brittle layer fractures to both crack and delaminate.

12. A closure according to claim 11 wherein there is a bond between said brittle layer and a material on said end panel, said material being selected from the group consisting of varnish, ink and coating.

13. A closure according to claim 11 wherein said end panel has a dark background beneath said brittle layer and said brittle layer has a light color whereby said end panel area covered by said brittle layer has a first dark color when said brittle layer is whole and a second light color when said brittle layer fractures due to flipping of said end panel.

14. A closure according to claim 13 wherein said brittle layer is colored with a fluorescent dye.

15. A closure according to claim 13 wherein there is a bond between said brittle layer and said end panel, and the material of said brittle layer is one wherein upon flipping of said end panel said brittle layer fractures to both crack and delaminate.

16. A closure according to claim 13 wherein said brittle layer is formed of a resin.

17. A closure according to claim 16 wherein said resin is a two part epoxy system based on diglycidyl ether of bisphenol A and a tertiary amine curing agent.

18. A closure according to claim 16 wherein said resin is epoxy functional polyacrylates.

19. A closure according to claim 13 wherein said dark background carries a message indicia which is viewable through said brittle layer in the unfractured state of said brittle layer and, when said brittle layer is fractured, said message indicia is no longer visible.

20. A closure according to claim 13 wherein said brittle coating carries message indicia of a color which blends with said color change system so as to normally not be visible and which appears when said brittle layer is fractured.

21. A closure including a flexible end panel having formed therein a sealing state indicating area, and an irreversible tamper indicating system carried by said end panel area and actuable by said area flipping from a seal indicating position back to an initial position due to energy stored within said end panel area, said tamper indicating system including a brittle area rupturable in response to flipping of said end panel, said end panel having a dark background beneath said brittle layer and said brittle layer having a light color whereby said end panel area has a first color when said brittle layer is whole and a second color when said brittle layer fractures due to flipping of said end panel.

22. A closure according to claim 21 wherein said brittle layer is colored with a fluorescent dye.

23. A closure according to claim 21 wherein there is a bond between said brittle layer and said end panel, and the material of said brittle layer is one wherein upon flipping of said end panel said brittle layer fractures to both crack and delaminate.

24. A closure according to claim 21 wherein said brittle layer is formed of a resin.

25. A closure according to claim 24 wherein said resin is a two party epoxy system based on diglycidyl ether of bisphenol A and a tertiary amine curing agent.

26. A closure according to claim 24 wherein said resin is epoxy functional polyacrylates.

27. A closure according to claim 21 wherein said dark background carries a message indicia which is viewable through said brittle layer in the unfractured state of said brittle layer and when said brittle layer is fractured, said message indicia is no longer visible.

28. A closure according to claim 21 wherein said brittle coating carries message indicia of a color which blends with said color change system so as to normally not be visible and which appears when said brittle layer is fractured.

* * * * *